United States Patent [19]

Bartsch

[11] 4,174,700

[45] Nov. 20, 1979

[54] FIREPLACE

[76] Inventor: Gunther M. Bartsch, P.O. Box 1935, Zephyr Cove, Nev. 89448

[21] Appl. No.: 848,908

[22] Filed: Nov. 7, 1977

[51] Int. Cl.[2] ..... F24B 7/00; F23L 3/00

[52] U.S. Cl. ..... 126/121; 126/131; 126/288; 126/293

[58] Field of Search ..... 126/120, 121, 135, 285 R, 126/288, 293, 131

[56] References Cited

U.S. PATENT DOCUMENTS

| | | | |
|---|---|---|---|
| 3,930,491 | 1/1976 | Miller | 126/121 |
| 4,049,194 | 9/1977 | Tice | 126/121 |
| 4,049,196 | 9/1977 | Bergami | 126/121 |
| 4,060,196 | 11/1977 | Goldsby | 126/121 |

*Primary Examiner*—Robert L. Wolfe

[57] ABSTRACT

This is a new fireplace, which is either constructed in place or is totally prefabricated in advance and placed within a building where desired. The fireplace is particularly characterized by a pair of overlapping hollow members placed within the throat of the fireplace above the combustion chamber, which hollow members are interconnected on each side to ducts, one side of which receives cool air and the other side of which expels hot air. Blowers are provided in the duct lines in order to force the hot air into the areas desired for maximum heating.

15 Claims, 13 Drawing Figures

FIG. 3
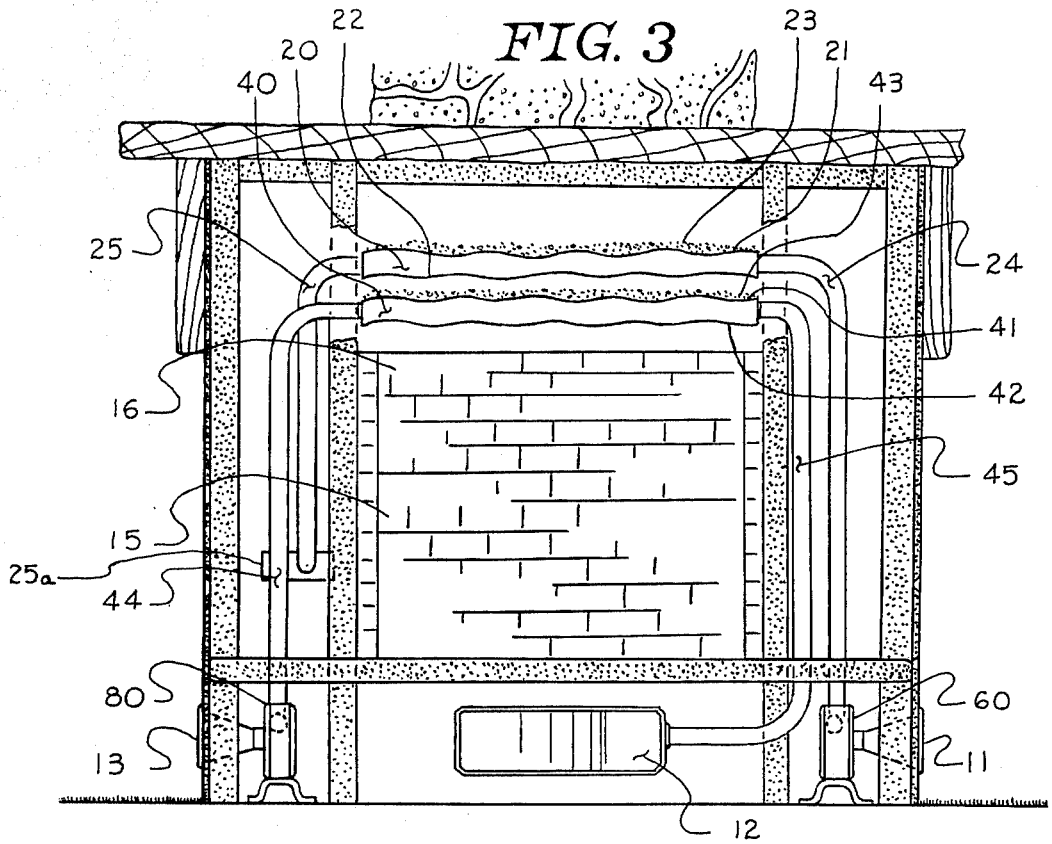
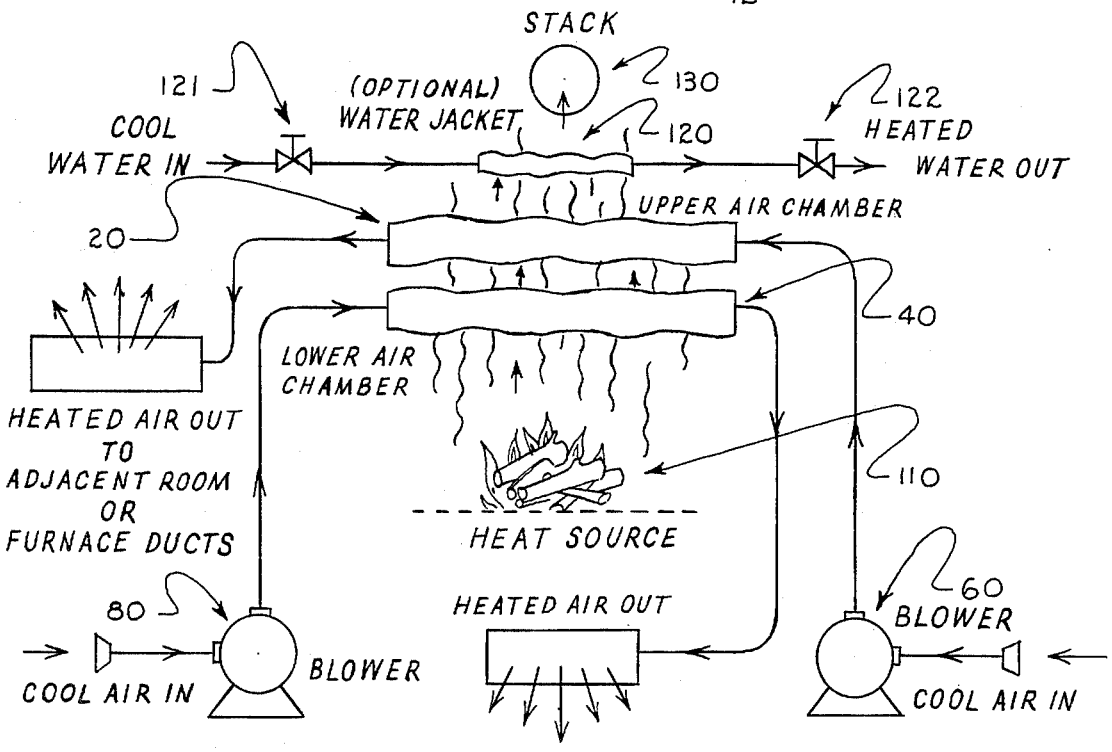
FIG. 4

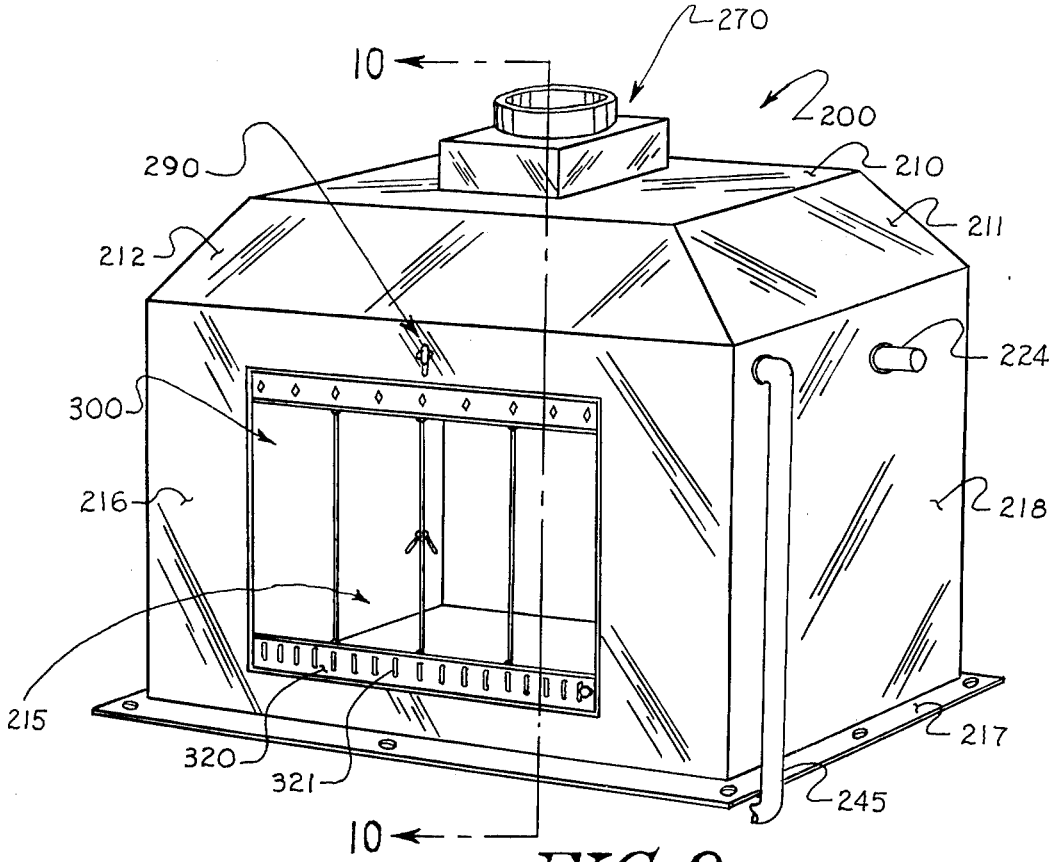
FIG. 9
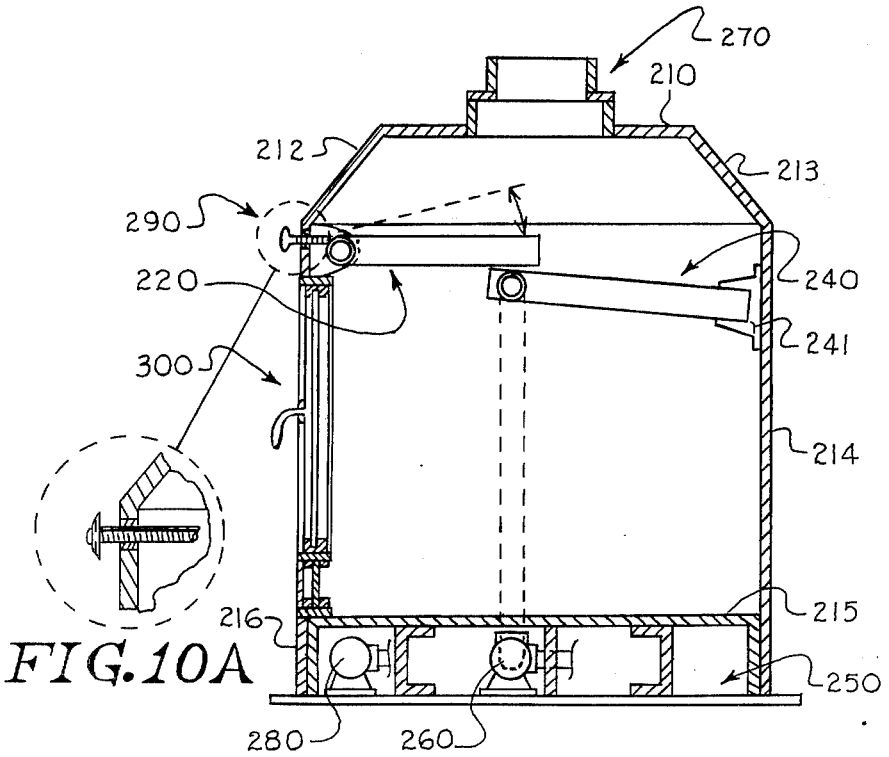
FIG.10A
FIG. 10

FIREPLACE

CROSS REFERENCE TO RELATED PATENT APPLICATIONS

There are no related patent applications filed by me.

BACKGROUND OF THE INVENTION

1. Field of the Invention

This invention is in the general field of fireplaces, and more particularly in the field of fireplaces wherein auxiliary heating chambers are provided within the fireplace, particularly above the combustion chamber, which auxiliary chambers receive cool air and expel hot air to various portions of the building as desired.

2. Description of the Prior Art

There have been many advances over the past several years in the field of fireplace arrangements wherein efforts are made to capture heat which is otherwise lost by going up the chimney, or is not effectively directed where it can be used for maximum heating purposes. All of these devices encompass metal shells, or the like, which are utilized to draw in cold air and expel heated air by reason of heat enerated adjacent said shells in the fireplace.

Numerous of such devices are on the market, and it would be difficult to describe them all. All, however, work on basically the same principle.

In the case of the present invention, a different theory is utilized wherein a pair of overlapping hollow chambers are used within the throat of the chimney above the combustion chamber and are interconnected to air ducts leading from a supply of cool air to the area desired to be heated. Also, provisions are made for a relatively airtight seal about the front of the fireplace, as desired, for maximum combustion efficiency through fine draft adjustment arrangements and through the utilization of the auxiliary overlapping hollow chambers for reducing the outlet area thus providing for a maximum and continuing combustion chamber.

SUMMARY OF THE INVENTION

I have been engaged in the installation of fireplaces in various housing structures for some period of time, and I have also become familiar with the fuel and energy shortages in the United States and the desirability of achieving maximum effectiveness of heating from fireplaces.

It is well known that fireplaces are generally very inefficient as heating devices, but are utilized because of their attractiveness and desirability.

A number of innovations have been made over a period of years, which have attempted to enhance the heating quality of fireplaces, as well as the efficiency.

Most of the new fireplaces designed to be more efficient include a hollow metal shell, or the like, such as the well known, "Heatilator" and the like. Also, efforts have been made to provide for heat reflecting surfaces, or the like, in conjunction with fireplaces.

All of the devices devised to date have the common quality that they attempt to direct more heat in the area in front of the fireplace.

In general, the devices involved do not provide for maximizing the combustion of wood or other fuels burned in a fireplace, and, additionally, they do not provide for the distribution of heat to other areas. Likewise, the devices now in use do not take advantage of the large amount of heat which appears at the very throat of the fireplace.

I have now devised a system wherein I utilize a hollow chamber above the throat of the fireplace, encompassing most of the area, with a moveable hollow chamber cooperatively arranged so as to act as a damper when desired in connection with the first mentioned chamber.

I have connected air intakes to one side of each of the two hollow chambers, with heated air outlets on the other side of each of said chambers. The outlets are then connected to ducts which can lead to other rooms or other portions of the home, or can be directed into the same room in which the fireplace is located, and can even be directed into a central heating system of the building.

Normally, blowers are used to force the air through the heating chambers in the throat of the fireplace, and in at least one alternate embodiment I am able to connect to the water system and heat water as well.

I also provide an airtight glass door having finely adjustable vents for draft. In this manner I am able to control the combustion rate and can provide fires which will last abnormally long periods of time and will be extremely efficient in their burning of the fuel which is used in them.

It is an object of this invention to provide a fireplace having special heating chambers connected to ducts which can take heat from the fireplace to other portions of a building.

Another object of this invention is to provide such a fireplace as described wherein the heating chambers act as a damper in cooperation with one another.

Another object of this invention is to provide such a fireplace as described wherein the amount of air entering the combustion chamber of the fireplace may be controlled.

The foregoing and other objects and advantages of this invention will become apparent to those skilled in the art upon reading the description of a preferred embodiment which follows in conjunction with the appended drawings.

BRIEF DESCRIPTION OF THE DRAWINGS

FIG. 3 is a section on 3—3 of FIG. 1;

FIG. 4 is a schematic diagram illustrating the air flow and elements of this invention;

FIG. 9 is a perspective of an alternate, free-standing embodiment of this invention;

FIG. 10 is a section on 10—10 of FIG. 9; and

FIG. 10A is an enlarged view of the area 290 of FIG. 10.

DESCRIPTION OF A PREFERRED EMBODIMENT

Figure 1:
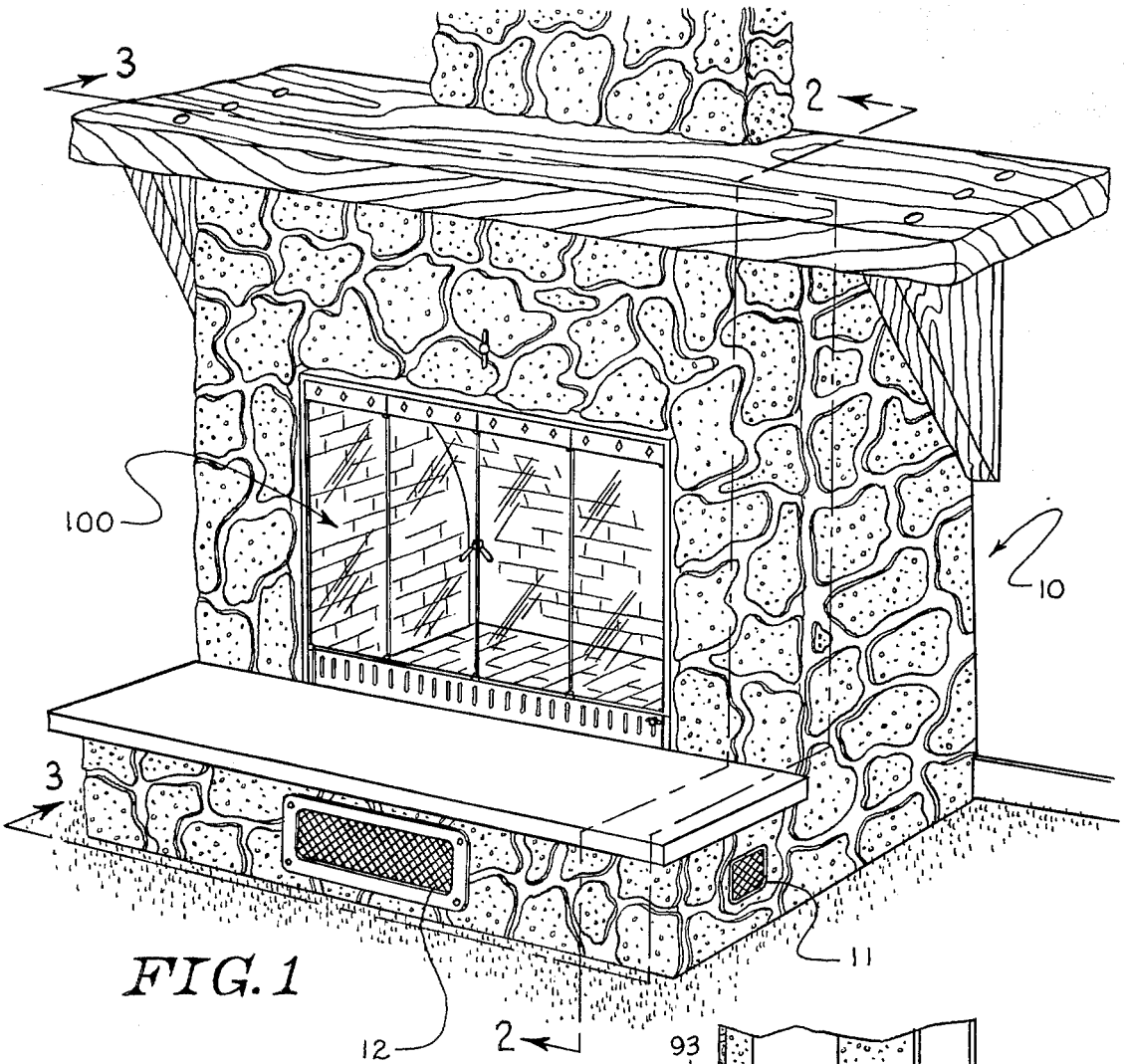
FIG. 1 is a perspective of a fireplace utilizing a preferred embodiment of this invention.

FIG. 1 illustrates a fireplace, generally 10, of relatively common construction in outward appearance. The only features illustrated on FIG. 1 which are unusual to this invention are the air duct screens 11 and 12 and the door 100.

Figure 2:
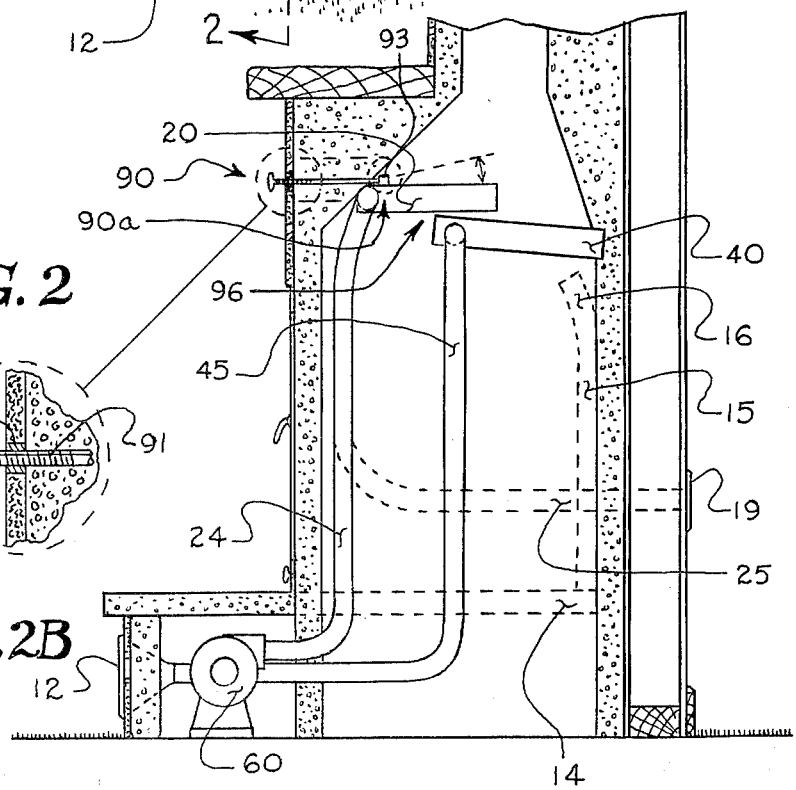
FIG. 2 is a section on 2—2 of FIG. 1.
Figure 2A:
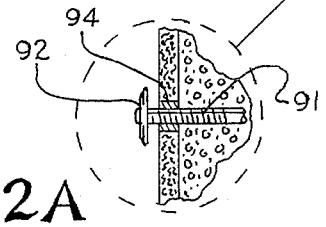
FIG. 2A is an enlarged view of the portion 90 of FIG. 2.
Figure 2B:
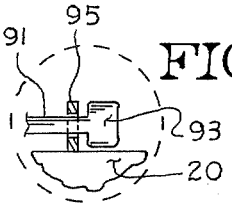
FIG. 2B is an enlarged view of the portion **90*a* of FIG. 2**.

FIG. 2 is an illustration of unusual features involved in the fireplace of this particular invention. The masonry construction of the fireplace will, of course, be generally of a customary nature. The floor of the fireplace will be somewhat elevated as indicated by the dotted lines and the area therein at 14. It is understood that this will be of brick, or the like, and the reason for showing it in dotted lines is for clarity and lack of interference with the ducts which will be further explained. For the purposes of this particular illustration, the section, while appropriate in general, has been made right at the wall itself, and the back wall (the other side) is not shown since details of the bricks and the like would interfere with this illustration. The back wall 15 has also been shown in dotted lines and this will normally be of bricks with a slightly curving upper end 16 as shown. This aids in the circulation and combustion of the gases within the fireplace.

A hollow chamber 40 (the details of which will be understood from a view of the further drawings) is embedded in, and held by, the rear masonry wall of the fireplace.

The moveable hollow chamber 20 is suspended and may be moved upward or downward as is described below and as will be clear in some of the other views.

The adjustment area 90 comprises a threaded rod 91 threadedly connected to a nut 94, or the like, mounted within the fireplace masonry, or the like, which threaded rod has an appropriate handle 92, or the like, for turning.

At the other end of the threaded rod there will be a boss 93, or the like, which will be fastened in a rotatable position (such as by a collar 95, or the like) to the chamber 20. Thus, by rotation of the handle 92, the chamber 20, being pivotally mounted, as explained below, can be allowed to move upward or downward and increase or decrease the draft area 96 between the chamber 20 and the chamber 40.

The duct 24 leading to one side of chamber 20 is connected to blower 60 which forces cold air through the duct 24 and into the chamber 20.

The duct 45 from chamber 40 is connected to the duct opening 12 so that air drawn into chamber 40 from the other side (not shown in this view, but explained below) will now be heated and will be forced out into the room.

Attention should now be directed to FIG. 3 which illustrates somewhat schematically, for clarity of understanding, the view on 3—3 of FIG. 1. The chamber 20 and the chamber 40 will normally have insulation such as asbestos, or the like, 23 and 43, respectively, fastened to the upper exterior portions of the chamber. It is understood that these chambers are hollow and, while no thickness is shown in this particular view, the chamber is composed of plates 41 and 42 for chamber 40, and 21 and 22 for chamber 20, respectively. Preferably, but not necessarily, these plates will have an irregular surface configuration as shown in order to facilitate the heating of the air by the tumbling action which will take place by air passing through such a tortured route. The chamber 40 has its intake 44 through which air is forced by the blower 80 received from the opening 13 as will be understood by those skilled in the art. The air which passes through chamber 40 and is heated therein will exit through duct 45 and may exit into the room in which the fireplace is located through grate opening 12 or by any other suitable means or to another location if it is desired to direct the air that way through the duct.

Cold air for chamber 20 will be received through the opening 11 into the blower 60 and through the duct 24 to the chamber 20. This air, heated in its travel through the chamber 20, will be directed through duct 25 through the rear wall behind the fireplace into another location such as through the duct outlet 25*a*, or the like.

FIG. 4 completely explains the action which takes place in the heating chambers heretofore described and also shows additional chambers which may be utilized. Chamber 40 is generally affixed to the rear of the fireplace and is above the fire being burned in the fireplace. It is generally out of sight and right at the throat of the fireplace as previously illustrated. A very great amount of heated air and gases will move upwardly as shown by the wavy lines and will pass over and about the lower exterior surface of chamber 40 and then will pass against the lower surface of chamber 20. This results in the chambers becoming very hot and, in the case of the lower chamber 40, air being drawn in through the blower 80 will take a course backward and forward in a tumbling manner such as is shown by the arrows within the chamber 40. By this, it is heated greatly and then exits due to the force of the blower 80 through any appropriate air duct opening.

The chamber 20 will act in a similar manner with the cool air, in this case, coming from the other side through blower 60 and exiting either to an adjacent room or to furnace ducts, or the like, as indicated.

Even after passing over these chambers, the air and gases exiting through the fireplace flue will have a considerable amount of heat which can be further extracted by another chamber similar to the two air chambers, but through which water could be connected, if desired, and in this manner auxiliary heating of water can be accomplished.

Figure 5:
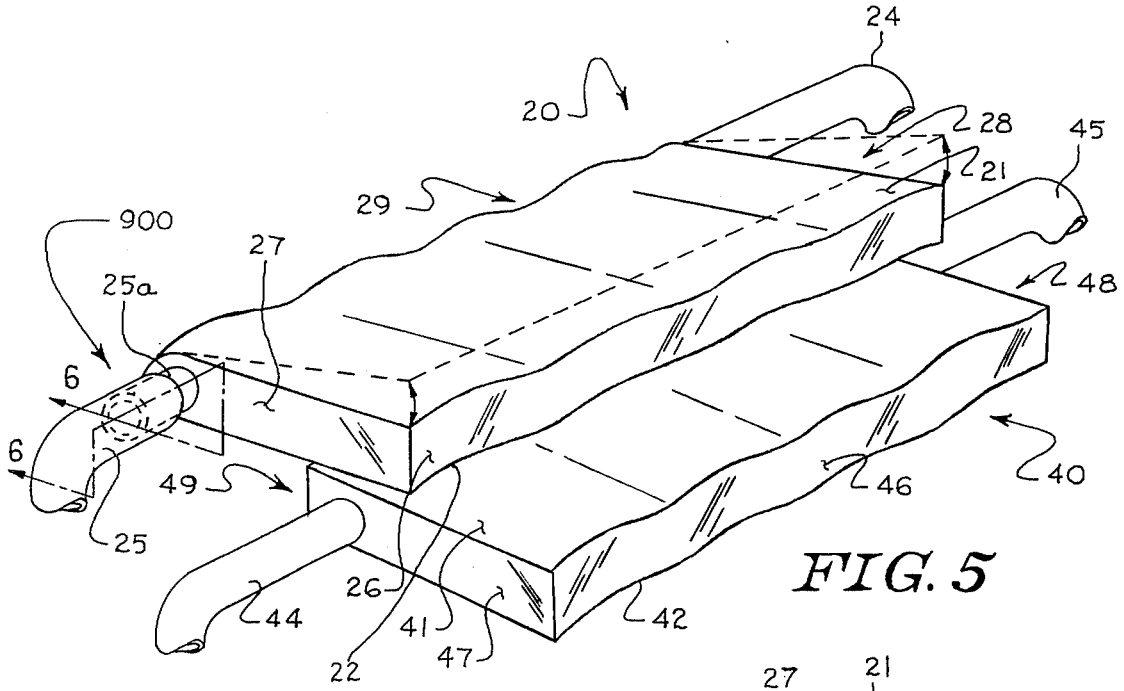
FIG. 5 is a partly broken-away, enlarged perspective of the chambers utilized in the embodiments of this invention shown before.

FIG. 5 is a perspective of the two chambers 20 and 40 shown so as to illustrate more clearly their structure. Chamber 40 is shown to have an upper surface 41, a lower surface 42, one end surface 47, another end surface 48 (not visible, but understood from the arrow location by those skilled in the art), a front surface 46, and a rear surface 49. Ducts 44 and 45 will be welded into the ends 47 and 48 approximately as shown.

The upper, moveable chamber 20 is somewhat more complex in its mounting. Its structure, however, is the same as that of chamber 40. It has a top surface 21, a bottom surface 22, ends 27 and 28, and front and rear surfaces 26 and 29. In this case, however, the duct 25 and the duct 24 will each serve as a pivot point for the pivoting action of chamber 20. A short stub pipe 25*a* will be welded or otherwise fastened to the chamber 20 as is shown particularly in FIG. 6. It is understood that a like arrangement will exist on the other side in combination with duct 24, which is not shown, but will be a mirror image of that shown in FIG. 6.

Figure 6:
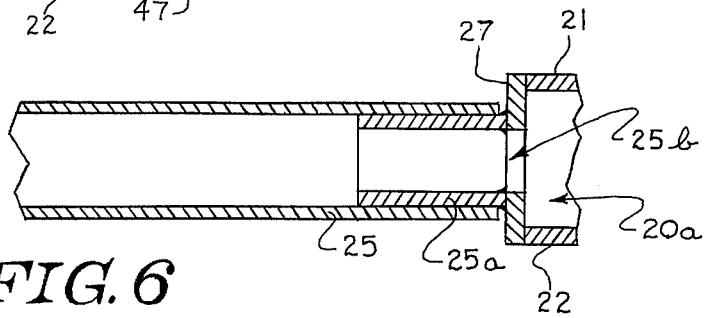
FIG. 6 is an enlarged view of the area 900 on FIG. 5 partially sectioned and broken away.

The chamber 20 is now illustrated in FIG. 6 in better detail showing the upper plate 21, the lower plate 22, and the end 25. These will be welded or otherwise fastened together and the chamber 20*a* will exist between the plates 21 and 22, and the ends 27 and 28, and front and rear 26 and 29.

The short stub pipe 25a is of such a size that it will rotate within the duct 25 providing a pivotal mounting. An opening 25b has been cut in end 27 to provide the air passage between the duct 25, stub 25a and the interior 20a of the chamber.

Figure 7:
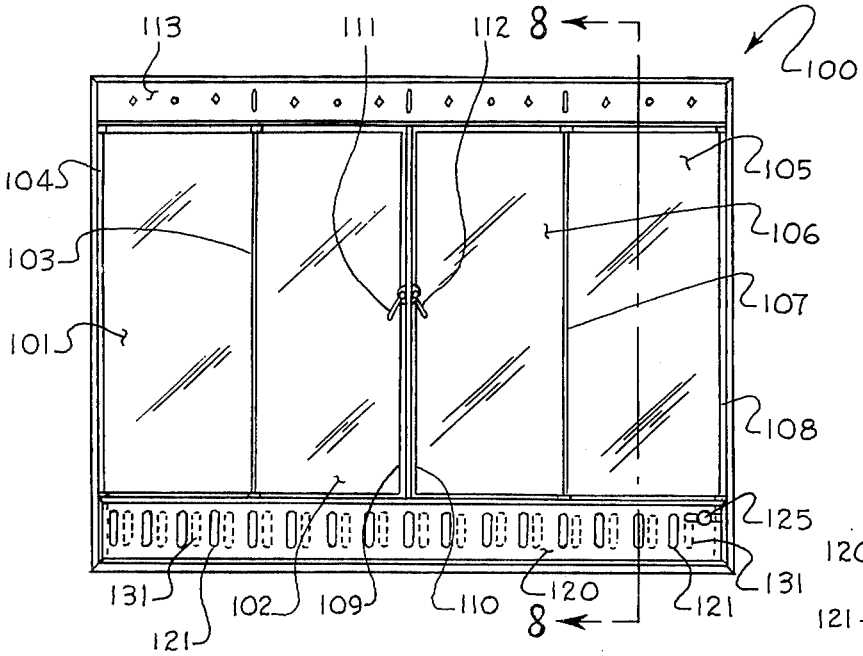
FIG. 7 is an enlarged front elevation of the door 100 shown in FIG. 1.
Figure 8:
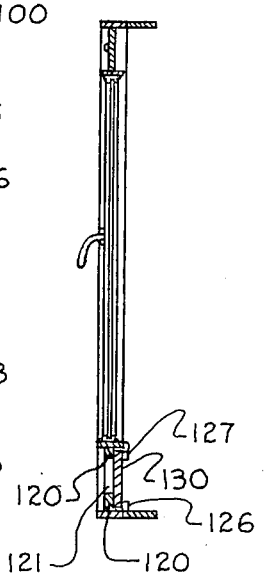
FIG. 8 is the section on 8—8 of FIG. 7.

FIG. 7 illustrates in better detail some of the features of the door arrangement as shown in FIG. 1. In this case, there are four fireproof glass panels 101, 102, 105 and 106. Panels 101 and 102 are hinged in a customary manner at 103 so as to fold outward when opened, and the panel 101 is hingedly fastened to the fireplace framework, in a manner known to those skilled in the art, by hinge 104, or the like. A like arrangement exists with folding hinge arrangement 107 between panels 105 and 106, and the hinge 108 to the fireplace opening frame.

Glass frame members 109 and 110 are provided with handles 111 and 112 which allow them to be locked together, as desired, in a relatively air-tight manner as is known to those skilled in the art.

A plate 120, having a series of openings 121, is affixed to the framework beneath the doors as shown.

A sliding plate 130, moveable by means of knob 125 affixed thereto, is in direct contact with plate 121. This plate slides in a track between plate 120 and numbers 126 and 127. Plate 130 has a series of openings 131 of the same size and spacing as openings 121. When plate 130 is aligned by utilizing the knob 125 operating in a slot within plate 120, so as to align all of the slots completely, there will be full ventilation into the fire resulting in rapid combustion. As it is desired to cut down the draft and the rate of combustion to achieve greater efficiency, the plate 130 is moved in such manner that the slots 121 and 131 come into partial alignment or are completely misaligned. Thus, the amount of draft can be accurately controlled.

FIGS. 9 and 10 illustrate an alternate embodiment of this invention. There is shown a fireplace constructed of metal which can be placed in position and masonry formed around it in order to install a fireplace utilizing the principles of this invention which can, in this manner, be prefabricated completely. Viewing FIGS. 9 and 10 together, it will be seen that there is a metal shell formed of plates 215, 216, 218 and 214. An opening is provided in plate 216 into which is fitted a glass door arrangement 300, being similar in its characteristics to the glass door heretofore described. The draft adjustment at 320-321 is also similar to the draft adjustment as previously described in detail and will not be repeated here.

A flange 217 is provided about the entire exterior as shown, which flange can be used for bolting into place on a masonry base, or the like.

Preferably, sloping panels such as 211 and 212 and 213 (a fourth one is not visible) will be provided to taper inwardly to the top 210 into which the exhaust flue 270 is fitted.

The heating chamber 240, having characteristics similar to those previously described, will be permanently fixed within bracket 241, welded or otherwise fastened to the back plate 214. An exit duct 224 will be provided on one side and the inlet duct, similar to that previously described, will be supplied with blower 260 fitted into a separate frame area 250 constructed of any suitable angle iron or the like. A steel floor 215 will be provided upon which bricks, or the like, may be laid and also bricks, or the like, may be utilized to cover the other interior surfaces of the combustion chamber.

The upper chamber 220 will have an adjustment at 290 similar to that previously described and shown in some detail in FIG. 10A, but without numerals since the same principles will apply as previously illustrated for tilting this chamber in the previous embodiment. It will be understood that, normally, the chamber 20 will only be pulled upward in order to increase the opening between the two chambers for draft purposes and that, when the tension holding it in the upper position is released, the weight will cause it to drop back into position on its pivotal mounting arrangement which will be similar to that previously described for the prior embodiment. The duct 245 as shown will be connected to the blower 280. A similar duct will exist between the blower 260 and chamber 240, and a stub outlet for the hot air from chamber 220 on the other side will exist similar to 224 as shown in FIG. 9.

Utilizing this particular embodiment, it can be installed upon a masonry floor, or the like, utilizing the flange 217 as its mounting. Masonry can then be formed completely about the unit, thus giving a masonry fireplace construction appearance.

The operations of the fireplace would be exactly the same as those previously described, with the chambers 240 and 220 providing a means to capture most of the heat which would otherwise escape up the flue.

The embodiment shown in FIGS. 9 and 10 will make it clear that the elements of this invention could easily be installed in a Franklin fireplace-stove, as well as in a regular fireplace. It is understood that any such installation is to be encompassed within the teaching of this invention.

While the embodiments of this invention shown and described are fully capable of achieving the objects and advantages desired, it is to be understood that such embodiments are for the sole purpose of illustration and not for purposes of limitation.

I claim:

1. The combination with a fireplace of: a first hollow chamber fixed to the fireplace structure and covering a portion of the fireplace throat; a second hollow chamber pivotally connected to said fireplace structure in such manner as to be capable of covering essentially all of said fireplace throat in combination with the said first chamber and moveable in such manner as to create an opening between the said two chambers within the throat; a first air inlet means connected to the interior of said first chamber; a second air inlet means connected to the interior of said second chamber; a first hot air outlet means connected to the interior of said first chamber; a second hot air outlet means connected to the interior of said second chamber; and means to cause air to circulate through each of said chambers from its inlet to its outlet means.

2. The apparatus of claim 1 wherein the said chambers are located within a fireplace shell structure.

3. The apparatus of claim 1 wherein the said fireplace is provided with an opening which has essentially air-tight closeable doors located therein.

4. The apparatus of claim 3 wherein adjustable vent means are provided in cooperation with said fireplace doors to allow varying amounts of air to enter the fireplace.

5. The apparatus of claim 4 wherein the said second chamber is located above the first chamber and overlaps said first chamber.

6. The apparatus of claim 5 wherein said second chamber is pivotally connected to said fireplace structure by means of said second inlet and second outlet means.

7. The apparatus of claim 6 wherein a third chamber is provided in a fixed relationship within the throat of the fireplace and above the first two chambers and wherein said chamber has a third inlet and third outlet means.

8. The apparatus of claim 7 wherein the said third inlet is connected to a water supply and the said third outlet is a means to withdraw water.

9. The apparatus of claim 4 wherein means are provided connecting from the exterior of said fireplace structure to said second chamber which means pivot said second chamber so as to increase or decrease the amount of opening between the said second and first chambers.

10. The apparatus of claim 1 wherein the said chambers are located within a Franklin-type fireplace-stove.

11. The apparatus of claim 1 wherein each of said chambers has at least one exterior surface comprising an irregular configuration.

12. The combination with a fireplace of: (1) a first hollow chamber positioned within the fireplace at the upper extremity of the combustion chamber of the fireplace and extending from one wall of the fireplace for a distance from said wall but terminating at a spaced distance from the opposite wall; (2) a second hollow chamber pivotally mounted adjacent the opposite wall of said fireplace from which the first chamber is depending, and so mounted as to form, in conjunction with the first chamber, a nearly complete closure of the fireplace throat; (3) a first air inlet duct connected to the interior of said first chamber; (4) a first blower conneced to said first inlet duct in such manner as to draw air from outside the fireplace into said duct and thence into said chamber; (5) a first air outlet duct interconnected to the interior of said first hollow chamber at a spaced distance from the said first air inlet duct; (6) a second air inlet duct interconnected to the interior of said second hollow chamber; (7) a second blower connected to said second air inlet duct in such manner as to draw air from the exterior of said fireplace into said duct and into said hollow chamber; (8) a second air outlet duct interconnected to the interior of said second hollow chamber; (9) means cooperative with said second hollow chamber and operable from the exterior of said fireplace to pivot said second hollow chamber on its pivotal mounting in such manner as to alter the relationship of closure between the two chambers in the throat of the fireplace; (10) door closure means openably closing the front opening of said fireplace; and (11) means associated with said door means for providing a varying amount of air into said fireplace from the vicinity of said door means.

13. The apparatus of claim 12 wherein the said second air inlet means and the said second air outlet means are connected to said second hollow chamber by means of secondary inlet and outlet means pivoting within said second inlet and outlet means.

14. The apparatus of claim 13 wherein the fireplace is a Franklin fireplace-stove type.

15. The apparatus of claim 13 wherein the fireplace is a metallic shell about which a masonry fireplace can be constructed.

* * * * *